US008110531B2

(12) United States Patent
Svarcas et al.

(10) Patent No.: US 8,110,531 B2
(45) Date of Patent: Feb. 7, 2012

(54) LUBRICANT ADDITIVE COMPOSITION SUITABLE FOR LUBRICATING, PREVENTING DEPOSIT FORMATION, OR CLEAN-UP OF TWO-STROKE ENGINES

(75) Inventors: Laimute R. Svarcas, Wickliffe, OH (US); Michael S. Brenner, Highland Hts., OH (US); Thomas A. Nau, Leroy Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 102 days.

(21) Appl. No.: 11/570,521

(22) PCT Filed: Jun. 29, 2005

(86) PCT No.: PCT/US2005/023035

§ 371 (c)(1),
(2), (4) Date: Dec. 13, 2006

(87) PCT Pub. No.: WO2006/004806

PCT Pub. Date: Jan. 12, 2006

(65) Prior Publication Data

US 2008/0009428 A1 Jan. 10, 2008

Related U.S. Application Data

(60) Provisional application No. 60/584,026, filed on Jun. 30, 2004.

(51) Int. Cl.
*C10M 105/38* (2006.01)
*C10M 105/58* (2006.01)

(52) U.S. Cl. ..... 508/485; 508/544

(58) Field of Classification Search ..... 508/283, 508/513, 459, 543, 544, 485, 492
See application file for complete search history.

(56) References Cited

U.S. PATENT DOCUMENTS

| | | | | |
|---|---|---|---|---|
| 4,105,571 | A * | 8/1978 | Shaub et al. | 508/237 |
| 4,326,972 | A * | 4/1982 | Chamberlin, III | 508/331 |
| 4,663,063 | A * | 5/1987 | Davis | 508/454 |
| 5,264,005 | A | 11/1993 | Blythe | |
| 5,880,075 | A * | 3/1999 | Hartley et al. | 508/501 |
| 6,232,279 | B1 * | 5/2001 | Steigerwald | 508/591 |
| 6,300,290 | B1 * | 10/2001 | L'Heureux et al. | 508/287 |
| 6,331,510 | B1 * | 12/2001 | Curtis et al. | 508/578 |

FOREIGN PATENT DOCUMENTS

| | | |
|---|---|---|
| WO | WO 03/089555 | 10/2003 |
| WO | WO 03/089556 | 10/2003 |
| WO | WO 03089555 A1 * | 10/2003 |

OTHER PUBLICATIONS

Search Report for corresponding PCT Publication No. PCT/US2006/004806 & Search Report; international publication date: Jan. 12, 2006.

* cited by examiner

*Primary Examiner* — Cephia D Toomer
*Assistant Examiner* — Pamela H Weiss
(74) *Attorney, Agent, or Firm* — Christopher D. Hilker

(57) ABSTRACT

A lubricant composition with a total nitrogen content of 0.1 to 0.25 percent by weight suitable for lubricating a two-stroke engine comprising an oil of lubricating viscosity, a synthetic ester, at least one condensation product of a fatty acid having 12 to 24 carbon atoms with a polyamine, and a Mannich dispersant.

19 Claims, No Drawings

LUBRICANT ADDITIVE COMPOSITION SUITABLE FOR LUBRICATING, PREVENTING DEPOSIT FORMATION, OR CLEAN-UP OF TWO-STROKE ENGINES

PRIORITY

This application claims priority back to U.S. Application No. 60/584,026.

BACKGROUND OF THE INVENTION

The present invention relates to a lubricant composition and fuel-lubricant mixture useful for clean-up of two-stroke engines. Two-cycle engine technology has been around since the end of the 19$^{th}$ century, when it was invented in England. At first this technology was simple and early applications were primarily for motorcycles. Evinrude developed the first outboard engine in the United States in 1909 with a 1.5 HP engine. Because of their light weight characteristics, these engines are frequently used in handheld power tools, such as chainsaws, brushcutters, concrete saws, string trimmers, and lawn edgers. With time these simple carbureted two-cycle engines have become more complex and they have now become incorporated into new and modern recreational products, such as snowmobiles, jet skis and all terrain vehicles.

Two-cycle engine technology evolved in conjunction with these various applications. Exhaust port modifiers were added to the carbureted two-stroke engine in order to increase power over the entire rpm range, without any significant engine modifications and without negatively impacting the excellent power to weight ratio inherent to this engine design. Later direct fuel injection technology was developed in order to reduce hydrocarbon HC emissions. Some applications combined these direct fuel injection systems with exhaust port modifiers, while other applications incorporated only one of these features. Today, many of the modern two-cycle outboard engines have direct injection systems for both fuel and air. This technology was developed by Orbital and in some of the more modern applications it is also used in conjunction with exhaust port modifiers.

Additive lubricant technology has more slowly evolved to meet the increasing demands of these new technological improvements and enhancements to the two-cycle engine. Frequently, lubricants have been developed in response to engine design changes and rarely in advance or in anticipation of some imminent modification. In fact, the effect of engine modifications on lubricant requirements can rarely be accurately predicted in advance. As a result, many new consumer engines are operated using oils of inappropriate or inferior quality. In other cases, the consumer simply does not recognize or understand the need for special lubricants for these different applications. In both cases the result is the same. The use of poor quality oils or inappropriate lubricants for a given application can lead to engine deposits on pistons, cylinder walls, cylinder heads and variable exhaust systems. Over time, a continuous build-up of these deposits will cause a decrease in overall engine performance and in the most severe cases can cause engine seizure or catastrophic failure.

Traditionally, engine performance has been restored by disassembling the engine and cleaning it by hand. Once the engine parts are cleaned, the engine is then rebuilt with these cleaned and/or replaced engine parts. Because modern two-cycle engines have become increasingly complex, this approach takes time, as well as an in-depth knowledge of how to disassemble and rebuild a two-cycle engine.

EP1138753A2 discloses a lubricant composition for air-cooled two-stroke cycle engine having a Mannich detergent and an ashless dispersant, wherein the ratio of the Mannich detergent to the ashless dispersant is 3:1 to 5:1. The detergency additive provides detergency when used in a lubricating oil composition for air-cooled two-stroke cycle engines.

WO03/89555 discloses a low nitrogen content composition suitable for use in a direct fuel injection two-stroke engine comprising an oil of lubricating viscosity and a combination of three nitrogen containing dispersants.

The present invention, therefore, solves the problem of two-cycle engine clean-up, by providing a new lubricant composition and fuel-lubricant mixture that can clean up deposits formed and prevent deposits from being formed in a two-cycle engine. This can then eliminate the cumbersome task of needing to disassemble an engine in order to clean deposits off and restore the engine to an appropriate operating condition.

SUMMARY OF THE INVENTION

The present invention provides a lubricant composition suitable for lubricating, while preventing deposit formation in, or cleaning, a two stroke engine comprising:

(a) an oil of lubricating viscosity;
(b) 0.5 to 30 percent by weight of a synthetic ester;
(c) 1.1 to 15 percent by weight of a Mannich dispersant;
(d) 0.5 to 8 percent by weight of at least one condensation product of a fatty acid having 12 to 24 carbon atoms with a polyamine, and
(e) a normally liquid solvent having a kinematic viscosity of less than 5 $mm^2/s$ at 100° C.

wherein the nitrogen content of the lubricant composition is 0.1 to 0.25 percent by weight.

The present invention further provides a fuel-lubricant composition comprising the above lubricant composition admixed with a major amount of a liquid fuel composition.

It further provides a method of lubricating a two-stroke engine, comprising supplying the lubricant composition to the engine. The lubricant can be supplied in admixture with a liquid fuel composition.

DETAILED DESCRIPTION OF THE INVENTION

Various preferred features and embodiments will be described below by way of non-limiting illustration.

The Oil of Lubricating Viscosity.

Oils of lubricating viscosity include natural and synthetic lubricating oils and mixtures thereof.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils such as polymerized and interpolymerized olefins (e.g., polybutylenes, polypropylenes, propylene-isobutylene copolymers, poly(1-hexenes, poly(1-octenes), poly(1-decenes), and mixtures thereof); alkylbenzenes (e.g., dodecylbenzenes, tetradecylbenzenes, dinonylbenzenes, and di(2-ethylhexyl)-benzenes); polyphenyls (e.g., biphenyls, terphenyls, and alkylated polyphenyls), alkylated diphenyl ethers and alkylated diphenyl sulfides and the derivatives, analogs, and homologs thereof.

Alkylene oxide polymers and interpolymers and derivatives thereof where the terminal hydroxyl groups have been modified by esterification, etherification, or similar reaction constitute another class of known synthetic lubricating oils. These are exemplified by the oils prepared through polymerization of ethylene oxide or propylene oxide, the alkyl and aryl ethers of these polyoxyalkylene polymers. However, synthetic esters, which are sometimes considered oil of lubricating viscosity, are separately considered, as a component (b) for purposes of this invention.

Unrefined, refined and rerefined oils (and mixtures of each with each other) of the type disclosed hereinabove can be used in the lubricant compositions of the present invention. Other oils that can be used are oils prepared from a gas-to-liquid process such as those involving Fischer-Tropsch processing.

The amount of lubricating oil in a fully formulated lubricant of the present invention (including the diluent or carrier oils present in additive packages) is typically 80 to 99.5 weight percent, preferably 85 to 96 weight percent, and more preferably 90 to 95 weight percent. The lubricating oil can also be used to prepare concentrates containing the additives of the present invention in higher concentrations. The amount of such oil in a concentrate is typically 20 to 80 weight percent.

The Synthetic Ester

The composition of the present invention also comprises an esters of a dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with any of variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from C5 to C12 monocarboxylic acids and polyols and polyol ethers such as neopentyl glycol, trimethylolpropane, pentaerythritol, dipentaerythritol, and tripentaerythritol. Esters can also be monoesters, such as are available under the trade name Priolube 1976™ (C18-alkyl-COO—C20 alkyl).

The amount of the synthetic ester is typically 0.5 to 30 percent by weight of the lubricating composition, in another embodiment 1 to 25 percent, or 2 to 10 percent or 2.5 to 5 percent.

The Dispersant(s)

The invention also contains at least two dispersants. The first dispersant is a Mannich dispersant, sometimes referred to as a Mannich base dispersant. Mannich dispersant is a reaction product of a hydrocarbyl-substituted phenol, an aldehyde, and an amine or ammonia. The hydrocarbyl substituent of the hydrocarbyl-substituted phenol can have 10 to 400 carbon atoms, in another instance 30 to 180 carbon atoms, and in a further instance 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent can be prepared by polymerizing olefin monomers by well known polymerization methods and are also commercially available. The olefin monomers include monoolefins, including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins. Useful polyolefins include polyisobutylenes having a number average molecular weight of 140 to 5000, in another instance of 400 to 2500, and in a further instance of 140 or 500 to 1500. The polyisobutylene can have a vinylidene double bond content of 5 to 69%, in a second instance of 50 to 69%, and in a third instance of 50 to 95%. The polyolefin can be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers.

The hydrocarbyl-substituted phenol can be prepared by alkylating phenol with an olefin or polyolefin described above, such as a polyisobutylene or polypropylene, using well-known alkylation methods.

The aldehyde used to form the Mannich dispersant can have 1 to 10 carbon atoms, and is generally formaldehyde or a reactive equivalent thereof such as formalin or paraformaldehyde.

The amine used to form the Mannich dispersant can be a monoamine or a polyamine, including alkanolamines having one or more hydroxyl groups, as described in greater detail above. Useful amines include those described above, such as ethanolamine, diethanolamine, methylamine, dimethylamine, ethylenediamine, dimethylaminopropylamine, diethylenetriamine and 2-(2-amino-ethylamino)ethanol. The Mannich dispersant can be prepared by reacting a hydrocarbyl-substituted phenol, an aldehyde, and an amine as described in U.S. Pat. No. 5,697,988. In an embodiment of this invention the Mannich reaction product is prepared from an alkylphenol derived from a polyisobutylene, formaldehyde, and an amine that is a primary monoamine, a secondary monoamine, or an alkylenediamine, in particular, ethylenediamine or dimethylamine.

The amount of the Mannich dispersant is typically 1.1 to 15 percent by weight of the lubricating composition, in another embodiment 1.5 to 10 percent, or 2 to 5 percent or 2.5 to 5 percent.

A second dispersant is a condensation product of a fatty hydrocarbyl monocarboxylic acylating agent, such as a fatty acid, with a polyamine.

The hydrocarbyl portion of the fatty hydrocarbyl monocarboxylic acylating agent can be an aliphatic group. The aliphatic group can be linear, branched, or a mixture thereof. The aliphatic group can be saturated, unsaturated, or a mixture thereof. The aliphatic group can have 1 to 50 carbon atoms, in another instance 2 to 30 carbon atoms, and in a further instance 4 to 22 carbon atoms, preferably 8, 10, or 12, to 20 carbon atoms. If the fatty hydrocarbyl moncarboxylic acylating agent is an aliphatic carboxylic acid, it may be seen as comprising a carboxy group (COOH) and an aliphatic group. Thus, the total number of carbon atoms in the carboxylic acid can be 2 to 51, or 3 to 31, or 5 to 23, or 9, 11, or 13 to 21. The monocarboxylic acylating agent can be a monocarboxylic acid or a reactive equivalent thereof, such as an anhydride, an ester, or an acid halide such as stearoyl chloride. Useful monocarboxylic acylating agents are available commercially from numerous suppliers and include tall oil fatty acids, oleic acid, stearic acid and isostearic acid. Fatty acids containing 12 to 24 carbon atoms, including C18 acids, are particularly useful.

A polyamine is an amine having two or more amine groups where a first amine group is a primary amine group and a second amine group is a primary or secondary amine group. The reaction product of the monocarboxylic acylating agent and the polyamine can contain, in greater or lesser amounts depending on reaction conditions, a heterocyclic reaction product such as 2-imidazoline reaction products as well as amide condensation products. The polyamine can have 2 to 30 carbon atoms. The polyamine can include alkylenediamines, N-alkyl alkylenediamines, and polyalkylenepolyamines. Useful polyamines include ethylenediamine, 1,2-diaminopropane, N-methyl-ethylenediamine, N-tallow($C_{16}$-$C_{18}$)-1,3-propylenediamine, N-oleyl-1,3-propylenediamine, polyethylenepolyamines such as diethylenetriamine and triethylenetetramine and tetraethylenepentamine and polyethylenepolyamine bottoms.

In another embodiment of the invention the monocarboxylic acylating agent and the polyamine are respectively a $C_4$ to $C_{22}$ fatty carboxylic acid and an alkylenediamine or a polyalkylenepolyamine, and in a further embodiment the fatty carboxylic acid is isostearic acid and the polyamine is a polyethylenepolyamine such as tetraethylenepentamine.

The monocarboxylic acylating agents and polyamines are commercially available. Their condensation products can generally be prepared by forming a mixture thereof at ambient to elevated temperatures of 50 to 200° C., and heating the mixture at elevated temperatures of 100 to 300° C. until the reaction product is formed in a satisfactory amount, as is more completely described in the reaction procedures in columns 37 and 39 of U.S. Pat. No. 4,724,091.

The amount of the condensation product of the monocarboxylic acylating agent and the polyamine is 0.5 to 8 percent by weight of the lubricating composition, in another embodiment 1 to 6 percent by weight, or 2 to 5 percent by weight or 2.5 to 5 percent by weight.

The total amount of all the dispersant is, in one embodiment 1 to 7.5 percent by weight, or 3 to 7 percent by weight, or 5 to 6 percent by weight.

The Nitrogen Content

Another property of the lubricant composition is a low overall total nitrogen content. Nitrogen refers to the nitrogen content as weight percent supplied by various additives, in particular, nitrogen-containing dispersants and any amine antioxidant. Low-nitrogen lubricant formulations can significantly reduce ring groove fill and heavy carbon deposition, thus eliminating ring jacking and subsequent engine seizure. In one embodiment the total nitrogen content is 0.05 to 0.3 percent by weight. In another embodiment the total nitrogen content is 0.1 to 0.25 percent by weight.

The amount of nitrogen contributing to the lubricant composition total nitrogen content from the nitrogen-containing dispersant(s) is important. In one embodiment the amount of elemental nitrogen delivered to the lubricant composition from the dispersant(s) is 0.1 to about 0.25 percent by weight, in another embodiment 0.15 to 0.2 percent by weight.

The Solvent

Another material commonly (but not necessarily) present in such lubricant compositions is a solvent, to aid in the solubility of the additives in the lubricant or in the fuel with which it is conventionally to be mixed. Typically such a material is a combustible solvent (other than oil of lubricating viscosity), having a flash point of less than about 105° C., in which the remaining components of the lubricant are soluble. The solvent is typically a hydrocarbonaceous solvent, that is, one which exhibits principally hydrocarbon character, even though relatively small numbers of heteroatoms may be present in the molecule. The solvent is preferably a hydrocarbon, and preferably having predominantly non-aromatic (e.g., alkane) character. The solvent thus preferably comprises less than 20 percent by weight aromatic components and is preferably substantially free from polynuclear aromatic components. (Aromatic hydrocarbons, in sufficiently large quantity, may contribute to smoke upon combustion and are thus sometimes less desirable.) A particularly suitable solvent is kerosene, which is a non-aromatic petroleum distillate having a boiling range of 180-300° C. Another useful solvent is Stoddard solvent, which has a boiling range of 154-202° C.

The solvent is characterized by a kinematic viscosity of less than 2 $mm^2 s^{-1}$ (cSt) at 100° C., preferably less than 1.5 or 1.0 $mm^2 s^{-1}$. Thus they are of lower viscosity than the oils of lubricating viscosity also employed in the invention.

The amount of the solvent is typically up to 45 percent by weight of the lubricant composition, preferably up to 40 or 35 or 30 percent. Often at least 20 or 25 percent solvent is present.

Other Components

Other conventional components may also be present, including olefin polymers such as polyisobutylene of relatively low molecular weight (e.g., 5000 or less, such as 500 to 2000, especially about 1000); pour point depressants; friction modifiers such as fatty esters; bright stock; viscosity index modifiers; metal deactivators; rust inhibitors, high pressure additives, anti-wear additives, and antifoam agents. Any of these materials can be present or can be eliminated, if desired.

Antioxidants (that is, oxidation inhibitors), including hindered phenolic antioxidants such as 2,6-di-t-butylphenol and 2,6 di-t-butylphenol with various substituents at the 4 position, including those derived from acrylate ester, secondary aromatic amine antioxidants such as dialkyl (e.g., dinonyl) diphenylamine, sulfurized phenolic antioxidants, oil-soluble copper compounds, phosphorus-containing antioxidants, molybdenum compounds such as the Mo dithiocarbamates, organic sulfides, disulfides, and polysulfides. An extensive list of antioxidants is found in U.S. Pat. No. 6,251,840.

The role of the corrosion inhibitor is to preferentially adsorb onto metal surfaces to provide protective film, or to neutralize corrosive acids. Examples of these include, but are not limited to ethoxylates, alkenyl succinic half ester acids, zinc dithiophosphates, metal phenolates, basic metal sulfonates, fatty acids and amines.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

Pour point depressants are used to improve the low temperature properties of oil-based compositions. See, for example, page 8 of "Lubricant Additives" by C. V. Smalheer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants are described in U.S. Pat. Nos. 2,387,501; 2,015,748; 2,655,479; 1,815,022; 2,191,498; 2,666,746; 2,721,877; 2,721,878; and 3,250,715.

The compositions of the present invention can be prepared by mixing the indicated components directly, or by preparing one or more of the components in the form of a concentrate, to which other components (such as oil or solvent) can subsequently be added.

The present invention also provides a method of lubricating, cleaning and cleaning up a two-stroke engine, comprising supplying a lubricant composition either to the crankcase of said engine or directly injecting the lubricant into the combustion chamber, or both, and operating said engine; wherein said lubricant composition is as defined above. The lubricant may be supplied undiluted as defined above, prediluted with fuel, or injected into the fuel flow before the transfer port. In one embodiment at least a portion of the lubricant composition is directly injected into the combustion chamber of the engine along with a liquid fuel. It has been found that use of the present lubricants results in significantly reduced deposition of carbon or varnish or engine parts, and use of certain lubricant formulations actually can lend to removal of such deposits formerly present in the engine.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples, which set forth particularly advantageous embodiments. While the Examples are provided to illustrate the present invention, they are not intended to limit it.

Lubricants are evaluated in three different tests. In the first test the lubricants are supplied to a liquid-cooled, two stroke 1996 model Yamaha 125 racing engine with a displacement of 124 $cm^3$ and an exhaust port timing system. After an initial break in period, the engine is run steady state for 10 hours at approximately 80% maximum brake horse power (BHP). The test oil is premixed with the fuel to provide a fuel/oil ratio of 50:1. The air to fuel ratio (AFR) is controlled based on the exhaust percent carbon monoxide (% CO). For this particular test procedure an eddy current dynamometer system is used to control engine speed and load. The test stand temperature is also controlled and monitored. Lubricants are evaluated at a premix fuel:oil ratio of 50:1. At the end of the 10 hour test the engine is disassembled for inspection.

The second test engine is a liquid-cooled, two stroke 2001 model 800 XC SP Polaris twin cylinder snowmobile engine with a displacement of 800 $cm^3$ and an exhaust port timing system, also known as power valves. This test stand is used to measure the performance of two-cycle lubricants under cyclic conditions in the areas of ring sticking, piston varnish, carbon deposition, plug fouling and lubricity for recreational vehicles. This engine has also demonstrated the ability to differentiate fluids with respect to power valve cleanliness. The engine is run in a three step cycle, including idle, wide open throttle, and 50 percent power, which is repeated four times an hour for 12 hours. The test oil is mixed with the fuel to provide a fuel/oil ratio that is varied by throttle position. The air to fuel ratio (AFR) is controlled based on the exhaust percent carbon monoxide (% CO). An Eddy current dynamometer system is used to control engine speed and load. In contrast to the Yamaha engine test stand, lubricants in this test procedure are evaluated at variable fuel/oil ratios based on throttle position during the different test cycles. At the end of the 12 hour test the engine is disassembled for inspection.

In the third test, the lubricant is supplied to a OMC 40HP, 45 cubic inch, two-stroke, water cooled spark ignition, outboard engine with specifically designed pistons and rings. A closed coolant system maintains engine temperature and a special load wheel replaces the propeller to obtain proper rpm at wide open throttle (WOT). The engine test is conducted for 125 hours at a 50:1 fuel:lubricant ratio using a 5 minute idle, 55 minute wide-open throttle cycle. The first 25 test hours are used to "dirty-up" the engine using the lubricant of Comparative Example 2, at the conclusion of which the engine is disassembled and rated. The engine is then reassembled and run on the "cleanup" oil formulation lubricant Example 3 for 50 hours, after which it is again disassembled and rated. The engine is reassembled for a third time and the clean-up oil is run for an additional 50 hours of "clean-up", for a total of 100 hours of "clean-up". The engine is again disassembled and rated to assess clean-up after 100 hours of operation. During the entire test, engine speed at WOT is maintained at 4500 rpm, coolant out is held at 77° C. and the fuel flow is controlled at 9.8 kg/hr. Deposit formation and clean-up performance at each test interval is evaluated by rating piston varnish, ring sticking and other engine deposit ratings.

Numerical ratings for all three engine test procedures are performed by calibrated Chemical Research Council (CRC) raters using the CRC rating manuals. Higher number ratings are indicative of better performance. As the rating numbers decrease, they represent poorer performance with more deposits that may cause possible ring sticking or may be difficult to remove from the power valves. In contrast, the depth of the deposits generated on the power valves using the snowmobile engine test procedure are measured using a Permascope, an industry standard method recognized by the lubricant industry. Thus the higher the Permascope number, the thicker the deposit. As a result in this test procedure, the lower numbers are indicative of better performance with respect to power valve cleanliness.

1. Example 1 (comparative) is a commercial synthetic two-stroke oil marketed for two-cycle engines containing exhaust port modifiers. (Bombardier™ XPS-II, available from Bombardier)
2. Example 2 (comparative) is a semi-synthetic commercial two cycle engine oil formulated to reduce carbon deposits, provide better lubrication and reduce wear in two-cycle engines. (Yamalube™ 2-W, available from Yamaha Motor Corporation, USA)
3. Example 3 is a clean-up oil of the present invention comprising the following:
   a. Mineral base oil mixture at 17.7% (including conventional diluent oil from other components)
   b. Pentaerythritol ester at 25%
   c. Polyisobutene at 28%
   d. Mannich prepared with dimethylamine at 7.24%
   e. Condensation product of isostearic acid and tetraethylenepentamine at 2%
   f. Aromatic amine anti-oxidant at 0.53%
   g. Glycerol monooleate (friction modifier) at 0.5%
   h. Rust inhibitor at 0.06%
   i. Solvent at 19%

TABLE 1

| Formulation | Nitrogen content (weight percent) |
|---|---|
| Example 1 | 0.21 |
| Example 2 | 0.12 |
| Example 3 | 0.23 |

Testing of the oils outlined in Examples 1 and 3, using the Yamaha engine test procedure, gives the following results: (on a scale of 0-10; higher numbers are better except as noted)

TABLE 2

| | Comparative Example 1 | Example 3 | % Rating Increase |
|---|---|---|---|
| Piston Ratings: | | | |
| Avg. Piston Varnish | 8.4 | 8.85 | 5.4% |
| Exhaust Side | 7.8 | 8.50 | 9.0% |
| Intake Side | 9.00 | 9.20 | 2.2% |
| Undercrown | 1.00 | 1.00 | 0% |
| Piston Scuffing | 9.00 | 9.00 | 0% |
| Piston Crown | 7.00 | 7.90 | 12.9% |
| Top Ring | 9.50 | 9.50 | 0.% |
| Top Ring Description | Sluggish | Sluggish | No Change |
| Cylinder Wall Condition: | | | |
| Cylinder Wall Varnish | 8.9 | 9.6 | 7.9% |
| Power Valve Deposits: | | | |
| Avg. Right Power Valve | 4.12 | 3.94 | −4.4% |
| Avg. Left Power Valve | 3.65 | 4.16 | 14.0% |
| Avg. Valve Set Rating | 3.89 | 4.05 | 4.1% |

Testing of the oils outlined in Examples 2 and 3, using the Polaris engine test procedure, gives the following results (on a scale of 0-10; higher numbers are better except as noted):

TABLE 3

| | Comparative Example 2 | Example 3 | % Rating Increase |
|---|---|---|---|
| Piston Ratings: | | | |
| Avg. Piston Varnish | 7.98 | 8.38 | 5.0% |
| Exhaust Side | 6.95 | 7.75 | 11.5% |
| Intake Side | 9.00 | 9.00 | 0% |
| Piston Scuffing | 6.75 | 6.75 | 0% |
| Piston Crown | 8.30 | 8.30 | 0% |
| Top Ring | 10.0 | 10.0 | 0% |
| Top Ring Description | Rings are free | Rings are free | No Change |
| Cylinder Wall Condition: | | | |
| Cylinder Wall Varnish | 5.6 | 8.2 | 46.4% |
| Power Valve Deposits (μ): (lower values are better) | | | Change in Deposit Depth |
| Overall Deposit Depth | 1.89 μm | 2.15 μm | 0.26 μm |

Testing of the oils outlined in Examples 2 and 3, using the OMC 40HP outboard engine test procedure, gives the following results (on a scale of 0-10; higher numbers are better excepted as noted):

TABLE 4

| Average Piston Deposit Ratings | | | |
|---|---|---|---|
| | Comparative Example 2 | Example 3 | |
| | 25 hrs. | 50 hrs. | 100 hrs. |
| Cylinder No. 1 | | | |
| Piston Skirt | 8.55 | 9.60 | 9.90 |
| Crownland | 5.50 | 6.90 | 7.70 |
| Second Land | 5.90 | 8.30 | 9.70 |
| Undercrown | 9.00 | 9.00 | 8.20 |
| Cylinder No. 2 | | | |
| Piston Skirt | 7.90 | 9.35 | 9.65 |
| Crownland | 4.70 | 6.20 | 7.40 |
| Second Land | 4.10 | 7.20 | 9.90 |
| Undercrown | 8.00 | 8.00 | 7.60 |

Note:
Comparative Example 2 was run in the engine for 25 hours to "dirty-up" the engine.

TABLE 5

| Adjusted Top Ring Sticking Ratings | | | |
|---|---|---|---|
| | Comparative Example 2 | Example 3 | |
| | 25 hrs. | 50 hrs. | 100 hrs. |
| Cylinder No. 1 | | | |
| NMMA Rating | 8.80 | 9.50 | 9.50 |
| Visual Rating | 8.40 | 9.50 | 9.50 |
| Cylinder No. 2 | | | |
| NMMA Rating | 8.60 | 9.00 | 10.00 |
| Visual Rating | 7.70 | 9.00 | 10.00 |

Note:
NMMA Rating is determined based upon the National Marine Manufactures Association guidelines.
Note:
Visual Ratings is determined based upon a CRC rating method.

The results shown in the tables above indicate that the lubricant of the present invention provides significant clean-up performance.

A further additional test, National Marine Manufactures Association test (NMMA) is run on the following formulations.

Example 4 (comparative):

TC-W3 certified commercial two-cycle oil comprising the following:

a. Alkyl amino phenol dispersant at 5.89%
b. Fatty acid imidazole dispersant at 1.1%
c. Succinimide dispersant at 1.30%
d. Dinonydiphenylamine antioxidant at 0.18%
e. Pour Point Depressant at 0.084%
f. Solvent at 18.51%
g. Polyisobutene at 3%
h. Base oil at 65% plus additional conventional diluent oil from other components Example 5 a. Mineral base oil mixture at 42% plus additional conventional diluent oil from other components
b. Priolube™ 3967 synthetic ester at 3%
c. Polyisobutene at 22%
d. Dimethylamine Mannich dispersant at 5.25%
e. Condensation product of isostearic acid and tetraethylenepentamine at 2.12%
f. Dinonydiphenylamine antioxidant 0.33%
g. Glycerol monooleate (friction modifier) at 0.35%
h. Rust inhibitor at 0.04%
i. Solvent at 24%

Example 6 a. Mineral base oil mixture at 44.5% plus additional conventional diluent oil from other components
b. Priolube™ 3967 synthetic ester at 3%
c. Polyisobutene at 22%
d. Dimethylamine Mannich dispersant at 3.71%
e. Condensation product of isostearic acid and tetraethylenepentamine at 1.5%
f. Dinonydiphenylamine antioxidant at 0.23%
g. Glycerol monooleate friction modifier at 0.25%
h. Rust inhibitor at 0.03%
i. Solvent at 24%

TABLE 6

| Formulation | Nitrogen content (weight percent) |
|---|---|
| Example 4 | 0.24 |
| Example 5 | 0.22 |
| Example 6 | 0.16 |

The above formulations are tested in a Mercury™ 15HP engine as part of qualification process to become a National Marine Manufactures Association (NMMA) approved and certified TC-W3® product. Example 4 is a TC-W3® certified lubricant. TC-W3® credentials insure that an oil meets the NMMA standards for performance in an out board application.

This test gives the following results:

TABLE 7

| | Example. 4 (comparative) | Example 5 | Example 6 | NMMA Requirement |
|---|---|---|---|---|
| Average Second Ring Sticking | 9.2 | 10 | 10 | 8.0 or greater |
| Average Second Land Deposits | 6.6 | 9.1 | 7.6 | 6.0 or greater |
| Compression Loss | 6.9 kPa (1.0 psig) | 6.9 kPa (1.75 psig) | 17.2 kPa (2.5 psig) | ≦138 (20 psig) |
| Percent Circumferential Scuffing | 0 | 0 | 0 | ≦15% |
| Percent Area Scuffing | 0 | 0 | 0 | ≦20% |
| Bearing Stickiness | PASS | PASS | PASS | PASS |
| Ring Wiping | 0 | 0 | 0 | ≦5% |

The results show that the invention provides superior engine cleanliness even at unusually low additive treat rates, permitting passage of the TC-W3® test.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

We claim:

1. A lubricant composition for a two-cycle engine comprising:

(a) an oil of lubricating viscosity;
(b) about 3.0 to about 25 percent by weight of a synthetic ester that comprises: an ester derived from pentaerythritol;
(c) about 3.7 to about 7.2 percent by weight of a Mannich dispersant prepared from an alkylene diamine and formaldehyde or a reactive equivalent thereof;
(d) about 1.5 to about 2.1 percent by weight of at least one condensation product of a fatty acid with a polyamine, where the fatty acid comprises isostearic acid and the polyamine comprises a polyalklyenepolyamine, and
(e) a normally liquid solvent having a kinematic viscosity of less than 5 cSt at 100° C.; and wherein the nitrogen content of the lubricant composition is about 0.1 to about 0.25 percent by weight.

2. The lubricant composition of claim 1 wherein the lubricant composition is ashless.

3. The lubricant composition of claim 1 wherein the lubricant composition further comprises one or more additional additives.

4. The lubricant composition of claim 1 wherein the lubricant composition further comprises a friction modifier, an antioxidant, a pour point depressant, a corrosion inhibitor or a mixture thereof.

5. A method of cleaning a two-cycle engine comprising the steps of: (I) supplying to said engine a clean-up composition comprising:

(a) an oil of lubricating viscosity;

(b) about 3.0 to about 25 percent by weight of a synthetic ester that comprises an ester derived from pentaerythritol;

(c) about 3.7 to about 7.2 percent by weight of a Mannich dispersant prepared from an alkylene diamine and formaldehyde or a reactive equivalent thereof;

(d) about 1.5 to about 2.1 percent by weight of at least one condensation product of a fatty acid with a polyamine, where the fatty acid comprises isostearic acid and the polyamine comprises a polyalklyenepolyamine, and (e) a normally liquid solvent having a kinematic viscosity of less than 5 cSt at 100° C.; and wherein the nitrogen content of the lubricant composition is about 0.1 to about 0.25 percent by weight.

6. The method of claim 5 wherein at least a portion of the clean-up composition is directly injected into the combustion chamber along with a liquid fuel.

7. The method of claim 5 wherein the clean-up composition is admixed with a major amount of a liquid fuel composition, and the resulting mixture is supplied to the engine.

8. The composition of claim 1 wherein component (b) is present at about 25 percent by weight, component (c) is present at about 7 percent by weight, and component (d) is present at about 2 percent by weight.

9. The composition of claim 8 further comprising a friction modifier, an antioxidant, a pour point depressant, and a corrosion inhibitor.

10. The composition of claim 1 wherein component (b) is present at about 3 percent by weight, component (c) is present at about 4 percent by weight, and component (d) is present at about 1.5 percent by weight.

11. The composition of claim 10 further comprising a friction modifier, an antioxidant, a pour point depressant, and a corrosion inhibitor.

12. The composition of claim 1 wherein component (b) is present at about 3 percent by weight, component (c) is present at about 5 percent by weight, and component (d) is present at about 2 percent by weight.

13. The composition of claim 12 further comprising a friction modifier, an antioxidant, a pour point depressant, and a corrosion inhibitor.

14. The method of claim 5 wherein component (b) is present at about 25 percent by weight, component (c) is present at about 7 percent by weight, and component (d) is present at about 2 percent by weight.

15. The method of claim 14 further comprising a friction modifier, an antioxidant, a pour point depressant, and a corrosion inhibitor.

16. The method of claim 5 wherein component (b) is present at about 3 percent by weight, component (c) is present at about 4 percent by weight, and component (d) is present at about 1.5 percent by weight.

17. The method of claim 16 further comprising a friction modifier, an antioxidant, a pour point depressant, and a corrosion inhibitor.

18. The method of claim 5 wherein component (b) is present at about 3 percent by weight, component (c) is present at about 5 percent by weight, and component (d) is present at about 2 percent by weight.

19. The method of claim 18 further comprising a friction modifier, an antioxidant, a pour point depressant, and a corrosion inhibitor.

* * * * *